US005957744A

United States Patent [19]

Mott et al.

[11] Patent Number: 5,957,744

[45] Date of Patent: Sep. 28, 1999

[54] CONSTRUCTION TOYS COMPRISING BUILDING BLOCKS AND SINGLE AND COMPOSITE ELONGATED STAR CONNECTORS

[75] Inventors: Jonathan Christopher Mott, Farnham; Martin John Bridges, Llandrillo, both of United Kingdom

[73] Assignee: Starlok International, Inc., Sebastopol, Calif.

[21] Appl. No.: 08/730,779

[22] Filed: Oct. 16, 1996

Related U.S. Application Data

[63] Continuation of application No. 08/146,046, filed as application No. PCT/GB92/00806, May 1, 1992, abandoned.

[30] Foreign Application Priority Data

May 3, 1991 [GB] United Kingdom ..... 9109914
Nov. 13, 1991 [GB] United Kingdom ..... 9124100

[51] Int. Cl.[6] ..... A63H 33/08; A63H 33/12

[52] U.S. Cl. ..... 446/127; 446/122

[58] Field of Search ..... 446/85, 86, 108, 446/111, 112, 114, 115, 116, 119, 120, 121, 122, 125, 126, 127, 128; 52/586.1, 586.2, 585.1, 605

[56] References Cited

U.S. PATENT DOCUMENTS

| | | | |
|---|---|---|---|
| 1,018,987 | 2/1912 | Philpot et al. | 52/586.2 X |
| 1,424,376 | 8/1922 | Purdy | 446/122 |
| 3,603,053 | 9/1971 | Van Loghem et al. | 52/566.2 X |
| 4,052,832 | 10/1977 | Jungers et al. | 52/586.1 X |
| 4,400,925 | 8/1983 | Van Loghem et al. | 52/586.1 X |
| 4,566,246 | 1/1986 | Sanger | 446/126 X |
| 5,061,219 | 10/1991 | Glickman | 443/120 X |
| 5,238,438 | 8/1993 | Glickman | 446/126 |
| 5,247,773 | 9/1993 | Weir | 52/586.2 X |

FOREIGN PATENT DOCUMENTS

| | | | |
|---|---|---|---|
| 1130785 | 2/1957 | France | 446/127 |
| 2372341 | 6/1978 | France | 52/586.2 |
| 631 778 | 6/1936 | Germany | 446/127 |
| 1 805 974 | 7/1969 | Germany | 446/127 |
| 1 805 769 | 8/1970 | Germany | 446/127 |

*Primary Examiner*—D. Neal Muir
*Attorney, Agent, or Firm*—David Pressman

[57] ABSTRACT

A constructional toy comprises main building blocks which are typically square, triangular or rectangular in cross-section and moulded in a suitable plastics material. Each block has respective dovetail-shaped grooves in each of its side faces. The toy also includes principal connecting elements each having a star-shaped cross-section, the grooves being complementary in shape to the shape of the half of any connecting element on one side of a plane which longitudinally bisects the connecting element and the opposed included angles between opposed pairs of adjacent points of its star shape. So two main elements can be secured together in at least four different orientations, successively spaced apart by 90°, by sliding one pair of adjacent points of a connecting element into a groove in one main element and sliding the same or another pair of adjacent points into a groove in the other main element.

20 Claims, 8 Drawing Sheets

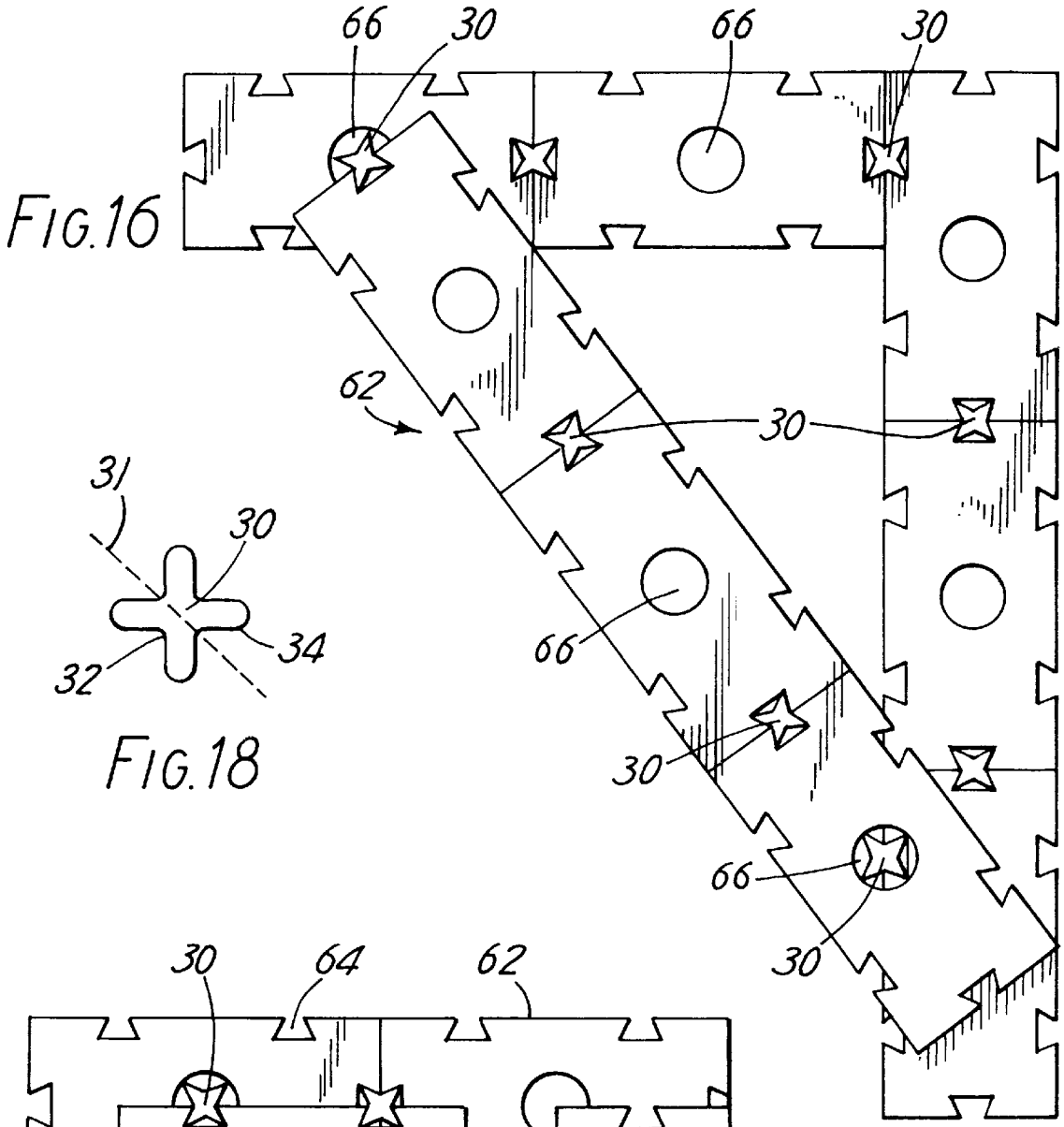
FIG.16
FIG.18
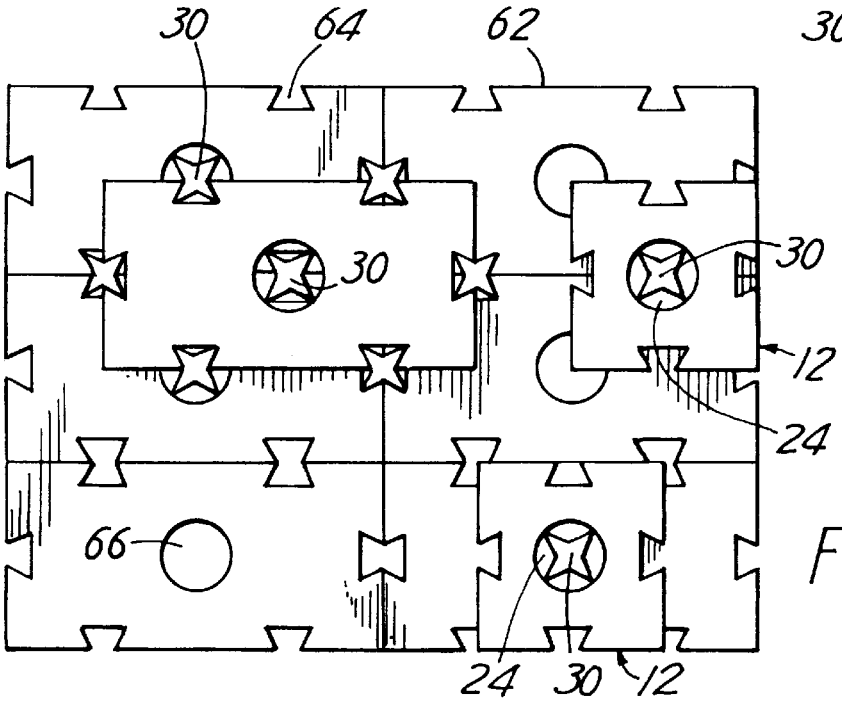
FIG.17

CONSTRUCTION TOYS COMPRISING BUILDING BLOCKS AND SINGLE AND COMPOSITE ELONGATED STAR CONNECTORS

BACKGROUND—CROSS REFERENCE TO RELATED APPLICATIONS

This application is a continuation of Ser. No. 08/146,046, filed Nov. 1, 1993 now abandoned, which is based upon PCT Application PCT/GB92/00806, filed May 1, 1992 which is based upon UK Applications 9,109,914.3, filed May 3, 1991; and 9,124,100.0, filed Nov 13, 1991.

BACKGROUND—FIELD OF INVENTION

This invention relates to constructional toys.

BACKGROUND—PRIOR ART

One prior art form of constructional toy is described in United Kingdom Patent Specification No. 959 581, and comprises main building elements consisting of rectangular panels having outer edges which engage in parallel grooves in the side faces of common connector elements, to build up generally box-like structures. While such a toy can build up a variety of box-like structures, its versatility, or ability to build up other shapes, is somewhat limited.

United Kingdom Patent Application No. 2 224 953 describes a constructional toy that goes a considerable way towards alleviating the lack of versatility of the prior art constructional toy. However, it is an object of the present invention to provide a constructional toy which is even more versatile than the constructional toy of United Kingdom Patent Application No. 2 224 953.

SUMMARY OF THE INVENTION

According to one aspect of the present invention, there is provided a constructional toy comprising a plurality of elements of at least two different types which can be assembled together to form a variety of three-dimensional structures, said elements including:

- a main element in the form of a building block having a plurality of flat side surfaces, at least one of said surfaces having a groove therein, said groove having a mouth narrower than the remainder thereof; and
- an elongate connecting element having a cross-section in the shape of a symmetrical four pointed star, said connecting element being a tight sliding fit in said groove, with any two adjacent points of its star-shaped cross-section trapped in the groove and the other two points disposed outside the groove;
- whereby two of said main elements can be secured together in four relative orientations, successively spaced apart by 90°, by means of one of said connecting elements engaged in a respective groove in each main element;
- wherein each main element has at least one cylindrical aperture extending thereinto with its axis parallel to the longitudinal axis of the groove, the diameter of said aperture being such that said connecting element is a tight sliding fit therein.

It will be appreciated that since said connecting elements can be pushed into said grooves in any one of four 90° spaced apart orientations of the connecting element about its longitudinal axis, and into said apertures in any angular orientation of the connecting element about its longitudinal axis, the constructional toy of the present invention has greatly increased versatility in relation to the constructional toy of United Kingdom Patent Application No. 2 224 953, in that a much greater variety of relative orientations between the main elements is achievable.

The points of the star-shape of the cross-section of the connecting element may be rounded or squared, in which case the side surfaces of each point are advantageously made substantially parallel to each other, whereby to render the star-shape substantially cruciform.

Typically, each groove is approximately dovetail-shaped in cross-section, and preferably shaped to be substantially complementary in cross-section to the cross-sectional shape of any two adjacent points of the star-shaped cross-section of the connecting element.

In another aspect of the invention, the grooves have slight indentations at each end thereof, which co-operate with complementary slight projections provided at each end of the connecting elements on each star point of their cross-sectional shape. The connecting elements may have further slight projections, similar to the firstmentioned projections but of twice the length, at their midpoints, again on each star point of their cross-sectional shape, for co-operating with said slight indentations. Additionally, the apertures may have slightly increased diameter portions, analogous to said slight indentations, at at least one end thereof, for co-operating with the projections on the connecting elements.

In yet another aspect of the invention, the toy advantageously includes at least one of several different, more sophisticated, auxiliary connecting elements each based upon a half connecting element constituted by the half of a complete connecting element on one side of a plane which longitudinally bisects the complete connecting element and the respective opposed included angles between opposed pairs of adjacent points of its cross-section, whereby said half connecting element has a flat side defined by said plane and two star points inclined at 45° in opposite directions to said flat side. Thus a first auxiliary connecting element may comprise two half connecting elements integrally jointed at the respective midpoints of their respective flat sides and extending at 90° to each other. A second auxiliary connecting element may comprise a single half connecting element having a complete connecting element integrally joined thereto and extending perpendicularly from the midpoint of its flat side. A third auxiliary connecting element may comprise a single half connecting element having a complete connecting element integrally joined thereto at one end thereof and extending perpendicularly to its flat side. A fourth auxiliary connecting element may comprise a single half connecting element having a tubular connecting element integrally joined thereto and extending perpendicularly from the midpoint of its flat side, said tubular element being dimensioned to be a tight sliding fit in the apertures in the main elements.

Conveniently, each main element has first and second substantially planar, parallel, ends which are interconnected by said side surfaces. Further, each of said side surfaces preferably extends perpendicularly to said ends.

Preferably, each main element has a cross-section, perpendicular to said side surfaces, in the shape of a rectangle or a regular polygon: in the latter case, some main elements may be triangular in cross-section, some may be square and some may be hexagonal. In a yet further aspect of the invention, triangular and square elements are provided in combination.

The main elements and connecting elements may be made in a plurality of heights, of which the greater heights are conveniently integral multiples of the smallest height.

Said side surfaces of the triangular, square and hexagonal main elements are preferably all of the same width, while for the rectangular main elements, the shorter side surfaces are preferably of the same width as the side surfaces of the triangular, square and hexagonal main elements and the longer side surfaces are preferably of twice this width.

In the triangular, square and hexagonal main elements, the axis of the cylindrical aperture preferably coincides with the central axis of the element, while in the rectangular main elements, there may be either two cylindrical apertures, with their axes coinciding with the central axis through each half of the element, or a single cylindrical aperture, with its axis coinciding with the central axis of the element.

In a preferred embodiment of the invention, the main elements are all hollow, with one of said planar ends closed and the other open.

Preferably, all the elements are moulded in a suitable plastics material, for example ABS, acrylic plastic, polystyrene or polypropylene.

The cylindrical aperture may extend either completely through its main element, or only partly therethrough: in the latter case, the aperture is preferably closed at said closed planar end of its main element.

BRIEF DESCRIPTION OF THE DRAWINGS

The invention will now be described, by way of example only, with reference to the accompanying drawings, of which:

FIGS. 14 to 17 show a variety of ways in which the elements of FIGS. 1 to 13 can be connected together;

FIG. 18 is a top view of an alternative form of the connecting element of FIGS. 6 and 7;

DESCRIPTION OF THE PREFERRED EMBODIMENTS

Figure 1:
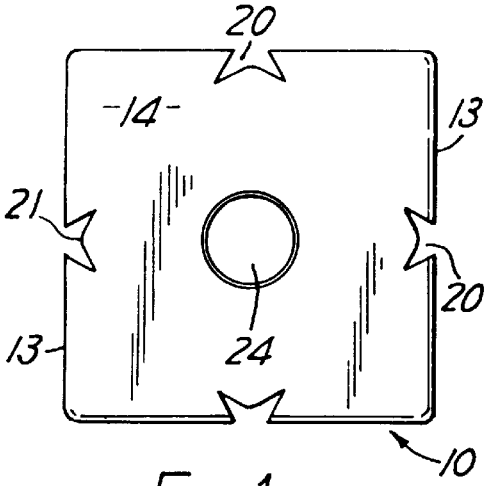
FIGS. 1 to 4 are respectively top, bottom, side and sectional views of one form of main building element of a constructional toy in accordance with the present invention.
Figure 2:
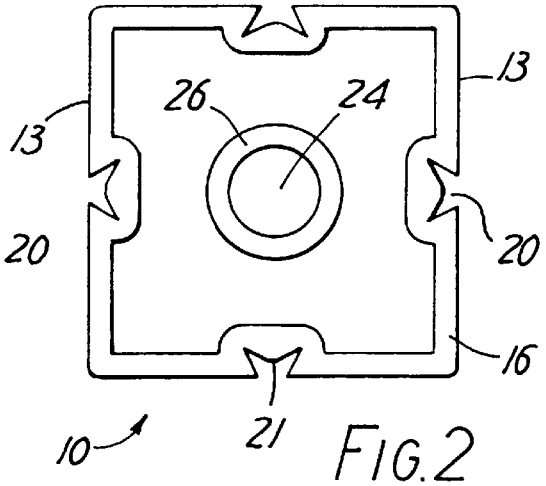

The main building element of FIGS. 1 to 5 is indicated generally at 10, and comprises a hollow square-section building block 12 having four identical rectangular side surfaces 13 each perpendicular to its two adjacent side surfaces and extending between substantially square and planar top and bottom ends 14, 16. The top end 14 is flat and substantially closed, while the bottom end 16 is open.

Each of the side surfaces 13 is provided with an identical generally dovetail-shaped groove 20 extending perpendicularly between the top and bottom ends 14, 16 along the middle of the side surface. The base of each groove 20 rises symmetrically from each side of the groove to a central ridge 21, which extends substantially the whole length of the groove and is provided at each end, for reasons which will become apparent hereinafter, with a slight cutaway portion or recess 22.

The block 12 is also provided with a cylindrical aperture or passage 24 whose axis extends from the centre of the top end 14 of the block to the centre of the bottom end 16: thus it will be appreciated that the axis of the aperture 24 extends parallel to the longitudinal axes of the grooves 20. This aperture 24 is defined by tubular walls 26 depending from and integral with the top end 14. The aperture 24 has a very slightly enlarged diameter portion 28 at its entrance in the top end 14 of the block 12, while the tubular walls 26 terminate just above the open end 16, again for reasons which will become apparent hereinafter.

The block 12 is moulded in one piece in a suitable plastics material such as ABS or polypropylene, and is typically 25 mm square by 25 mm high.

Figure 6:
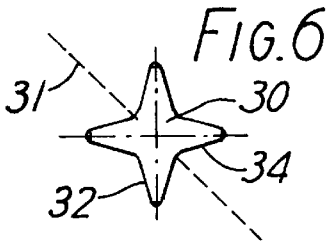
FIGS. 6 and 7 are much enlarged cross-sectional and side views respectively of a connecting element for use with the main building elements of FIGS. 1 to 5.
Figure 7:
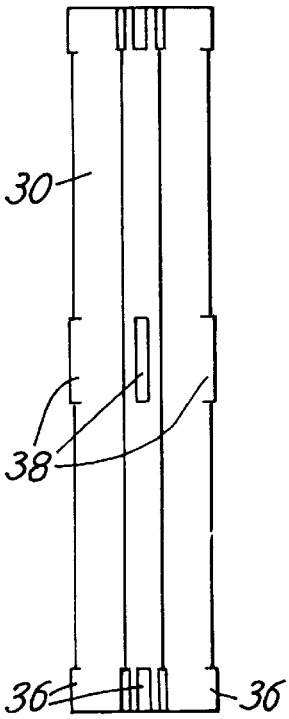

FIGS. 6–7—Connecting Element

The constructional toy of the present invention comprises plurality of the blocks 12, preferably moulded in different colours. Furthermore, and as will also become apparent hereinafter, differently shaped blocks, all having grooves and apertures similar to the grooves 20 and aperture 24, are also provided. A plurality of these differently coloured blocks 12 can then be joined together, both with each other and with the differently shaped blocks, to form a great variety of interesting and/or visually attractive three-dimensional structures, by means of elongate connecting elements of the kind indicated at 30 in FIGS. 6 and 7.

The connecting element 30 of FIGS. 6 and 7 is made of the same material and in the same range of colours as the blocks 12, and has a cross-section in the form of a regular four pointed star, ie a star with four points equiangularly spaced apart by 90°. The element 30 is again 25 mm long, and the dimensions of its cross-sectional shape are such that if the cross section is diagonally divided, as shown in FIG. 6 by dotted line 31, into two identical halves 32, 34 each containing two adjacent points of the star shape, then each half is closely complementary in shape to the cross-sectional shape of the grooves 20. As a result, each of the halves 32, 34 of the element 30 is a tight sliding fit within the grooves 20. Thus two of the blocks 12 can be secured together by placing respective ones of their side surfaces 13 in contact with each other, with the grooves 20 aligned with each other, and then sliding a connecting element 30 into both grooves 20 by sliding a respective one of its two-pointed halves 34, 36 into each groove. The two blocks 12 are then firmly secured together with respective ones of their side surfaces 13 held flush with each other.

The dimensions of the cross-sectional shape of the connecting element 30 and the diameter of the aperture 24 are selected such that the connecting element is also a tight sliding fit in the aperture 24. This greatly increases versatility, since it means that the blocks 12 can be connected together to partially overlap each other and in a variety of orientations, merely by engaging half the length of a connecting element 30 in the aperture 24 in one block, and the other half in a groove 20 or the aperture 24 in another block.

The connecting element 30 is further provided, at each end, with respective small projections or pips 36 typically 1.5 mm long, on each star point of its cross-sectional shape. Additionally, similar small projections or pips 38, typically 3.0 mm long, are provided on each star point of the cross-sectional shape of the connecting element 30 at the middle of its length. The pips 36 and 38 co-operate with the recesses 22 in the grooves 20, and with the enlarged diameter portions 28 of the apertures 24 and the shortened lower ends of the tubular walls 26, to provide a light locking action, detent, or "clicking into position", when the whole length or half the length of a connecting element is inserted into a groove or an aperture.

Figure 8:
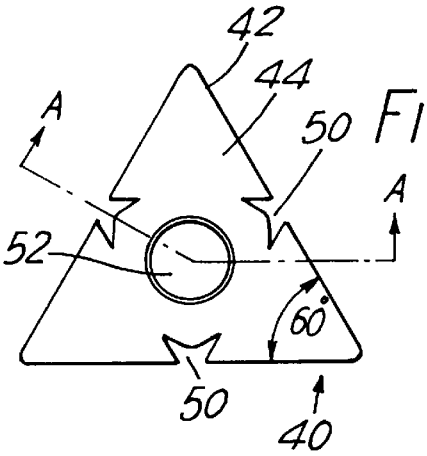
FIGS. 8 to 10 are respectively top, bottom and sectional views of another form of main building element of the constructional toy of the present invention.
Figure 9:
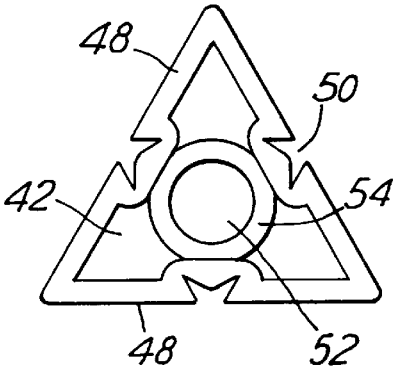
Figure 10:
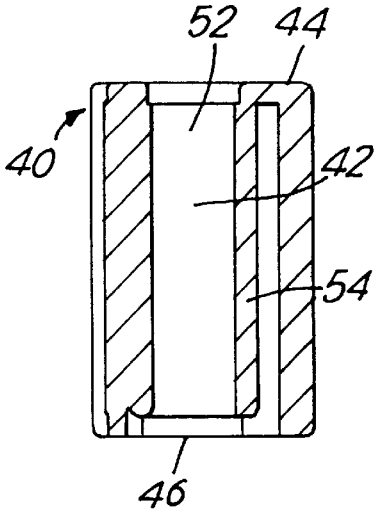
Figure 15:
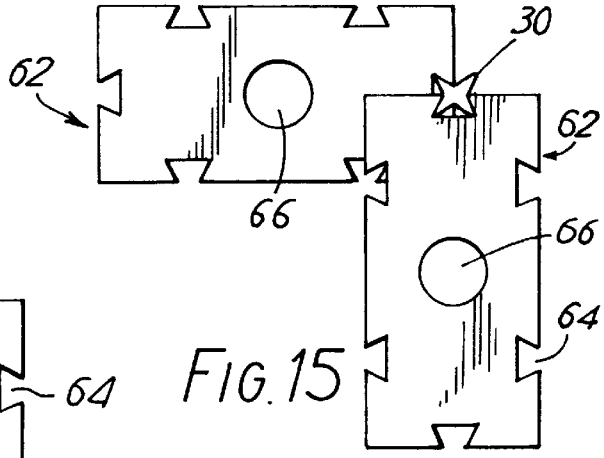
Figure 14:
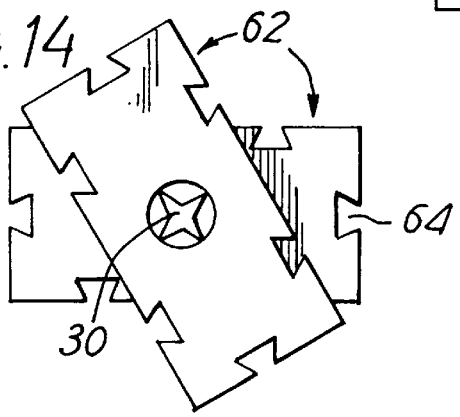

FIGS. 8–10—Three-Sided Block

The range of three-dimensional structures that can be built can be increased still further by incorporating additional main building elements 40 each in the form of a three-sided block of the kind indicated at 42 in FIGS. 8 to 10. The blocks 42 are again 25 mm high, and are made in the same material, and the same range of colours, as the blocks 12 of FIGS. 1 to 5. However, instead of being square, the blocks 42 have a cross-section in the shape of an equilateral triangle of 25 mm each side. Thus each block 42 has flat parallel top and bottom ends 44,46 interconnected by three identical side surfaces 48 perpendicular to the ends 44, 46 and each containing a central groove 50 identical to the grooves 20 of the blocks 12, the top end 44 being closed and the bottom end 46 being open. The blocks 42 also have central apertures 52 defined by tubular walls 54, both substantially identical to the aperture 24 and walls 26 of the block 12, and both having their axes parallel to the longitudinal axes of the grooves 50. The blocks 42 can therefore be connected to each other and to the blocks 12 by means of the connecting elements 30, again in a great variety of orientations.

Figure 11:
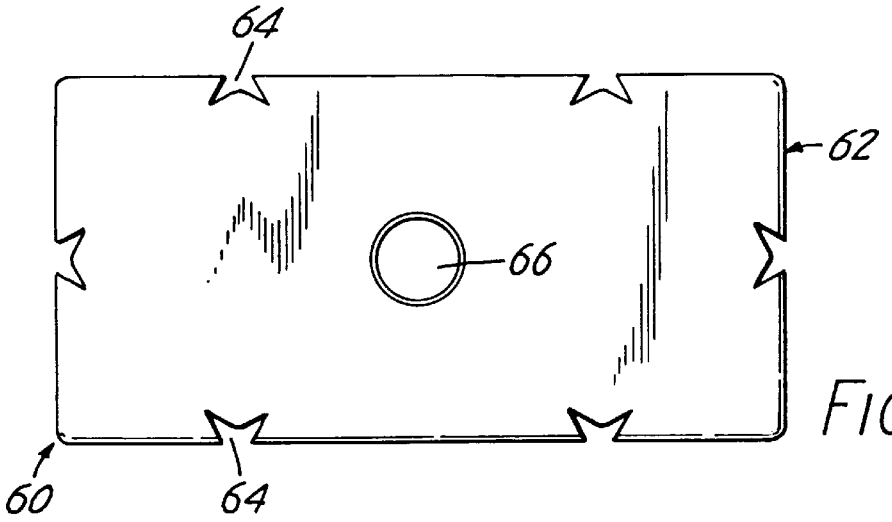
FIGS. 11 to 13 are respectively top, bottom and sectional views of yet another form of main building element of the constructional toy of the present invention.
Figure 12:
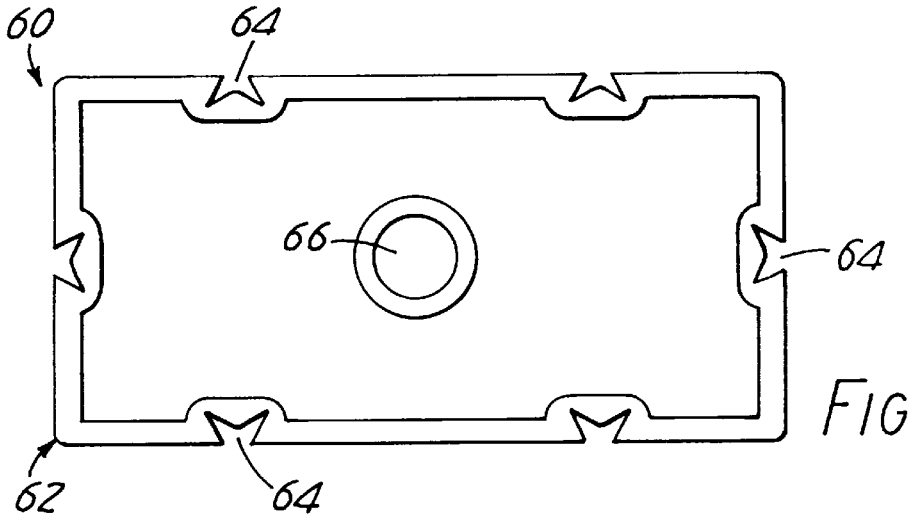
Figure 13:
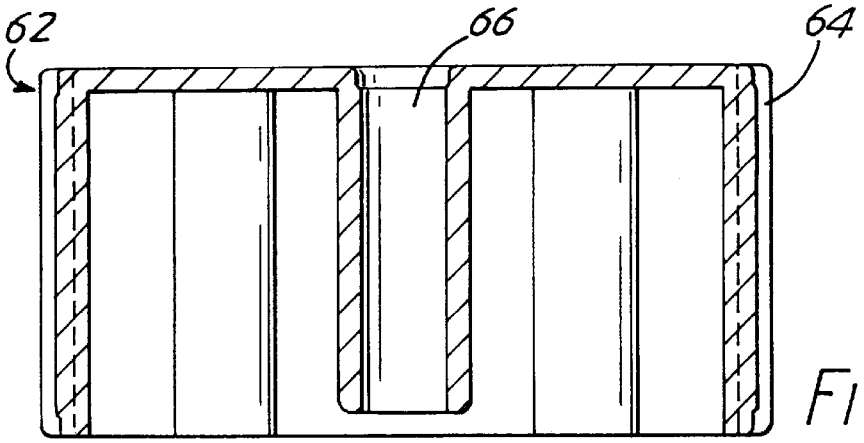

FIGS. 11–13—Rectangular Block

A third kind of main building element is shown at 60 in FIGS. 11 to 13. The element 60 comprises a rectangular block 62 which is effectively two blocks 12 having their respective side faces 13 integrally joined together, to form a single rectangular block 25 mm by 50 mm in cross-section by 25 mm high. As a result, the block 62 has two parallel grooves 64 in each of its longer sides, and either two apertures 66, one in the centre of each half, or preferably only one such aperture, in its centre, as shown in FIGS. 11 to 13.

FIGS. 14–17—Assembled Structures

FIGS. 14 to 17 illustrate by way of example just a few of the relative orientations in which the elements 60 can be connected together by the elements 30, as well as some of the resulting three dimensional structures that can be built using the elements 10 and the connecting elements 30. Clearly a great variety of such structures, especially solid geometrical structures of the polyhedron kind, can be built, depending almost entirely on the imagination of the builder. One of the features of the present invention which particularly facilitates the building of large complex structures is the very strong interconnection between the main building elements 10, 40 and 60 achieved by the engagement and light locking of the star shaped cross section of the connecting elements 30 in the complementarily-shaped grooves in the main building elements.

Yet another kind of main building element (not shown), in the form of a hexagonal section block with planar ends (one closed, one open), a central aperture and grooves in each of its six side faces, can be provided if desired, again with 25 mm side width, and again in the same range of colours as the blocks 12, 42 and 60, thus further extending the range of three-dimensional structures which can be built.

Several modifications can be made to the described embodiment of the invention.

Figure 3:
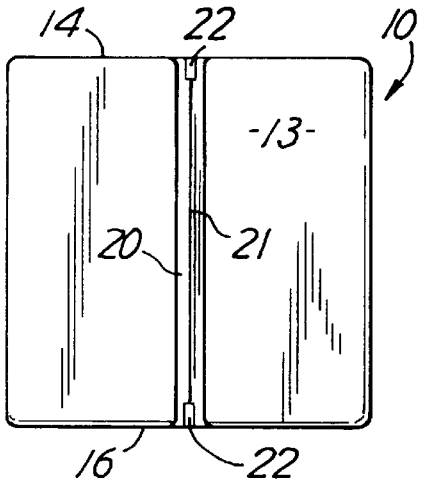

For example, the dovetail-shaped grooves 20, 50 and 64 need not have the precise cross-section as shown in FIGS. 1 and 3, they merely need to be narrower at the mouth than at their base: the term "dovetail-shaped" as used herein is therefore used to embrace such shapes.

FIG. 18—Cruciform Connecting Element

Furthermore, the star-shaped cross-section of the connecting elements 30 can be modified by rounding or squaring the points of its star shape, and additionally by making the side surfaces of each point substantially parallel to each other. In this latter case, the star-shaped cross-section of the connecting elements 30 is rendered substantially cruciform, as shown in FIG. 18. Also in this latter case, the dovetail-shaped grooves 20, 50 and 64 are preferably shaped to be substantially fully complementary to one diagonal half of the cruciform version of the star-shaped cross-section of the connecting elements 30, so increasing the area of contact between the connecting element and the groove 20, 50 or 64 of the respective block 12, 42 or 60. This increased contact area has the advantage that the connecting elements 30 connect the blocks 12, 42 or 60 together more firmly or securely by virtue of the increased frictional engagement.

Figure 4:
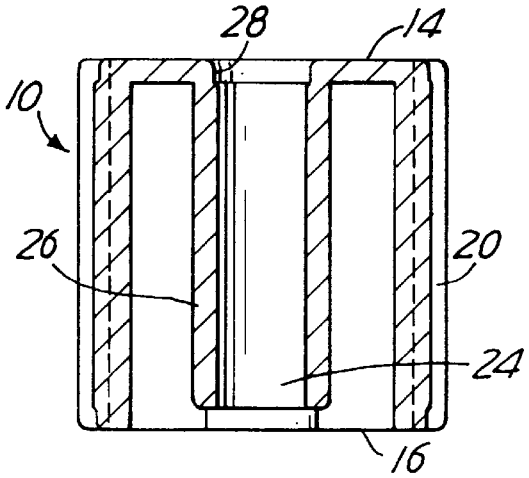
Figure 5:
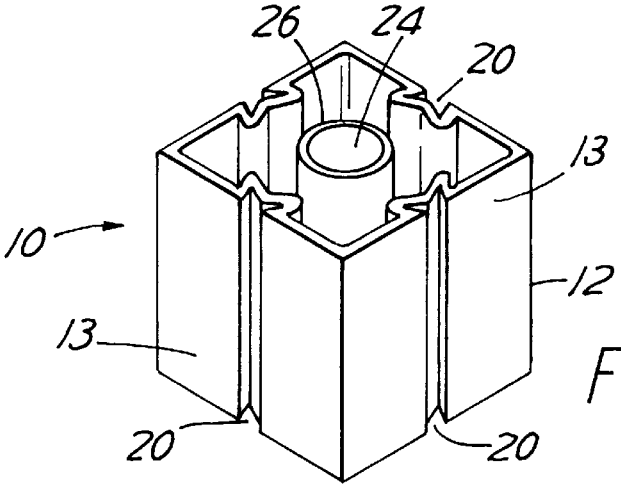
FIG. 5 is a perspective view of the element of FIGS. 1 to 4 from its underside.

In another modification, some of the apertures 24, 52 and 66 can be blind, rather than extending all the way through their respective blocks 12, 42 and 60: this modification is preferably implemented by closing the respective upper ends of the apertures 24, 52 and 66, as viewed in FIGS. 4, 10 and 13 respectively.

Also, dimensions other than those specifically mentioned can be used, and at least some of the various blocks 12, 42 and 60 can be provided in their respective end surfaces with grooves identical to those in their respective side surfaces, to increase the number of orientations in which the blocks can be connected together. Further, specialised building elements can be provided if desired, in particular elements incorporating wheels, thus enabling various trucks and trailers to be built.

Although the use of the word "height" implies that the various building elements are used in the orientation in which they are shown in the drawings, they can in fact be used in other orientations if desired, especially one in which the dimension referred to as "height" extends horizontally.

Auxiliary Connecting Elements

In addition to the principal connecting elements 30 of FIGS. 6 and 7 and FIG. 18, the constructional toy of the present invention can also include a number of different auxiliary connecting elements, each based upon the half of a principal connecting element on one side of a plane which longitudinally bisects the principal element and the respective opposed included angles between opposed pairs of adjacent points of its cross-section, such that said half connecting element has a flat side defined by said plane and two star points inclined at 45° in opposite directions to the normal to said flat side. I.e., the auxiliary connecting element comprises first and second elongated portions which lie on respective sides of a plane which longitudinally bisects the connecting element. The first portion has a generally V-shaped cross-section with two arms defining an angle between them and a flat base that lies on the plane, such that the arms extend out in two different directions from the plane. The second portion is also elongated and lies on the other side of the plane and is attached to the base of said first portion and extends at an angle to the first portion.

Figure 19:
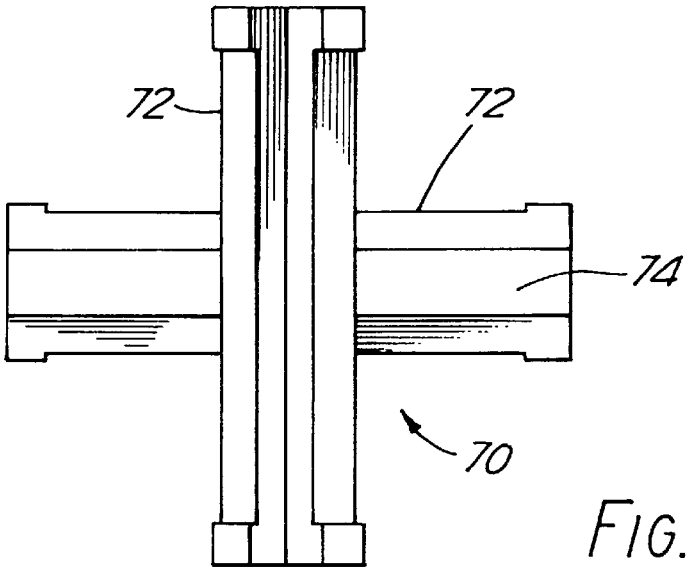
FIGS. 19 to 21 are plan, side and perspective views respectively of an auxiliary connecting element of the constructional toy of the present invention.
Figure 20:
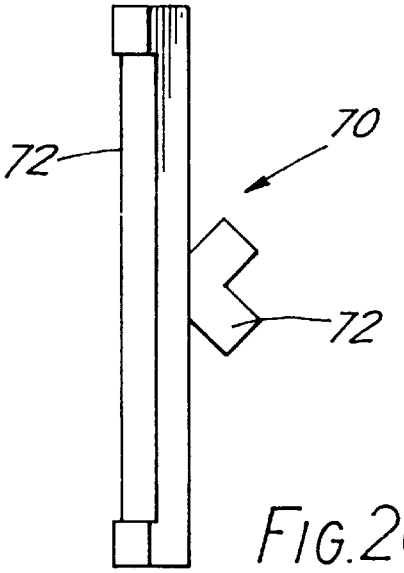
Figure 21:
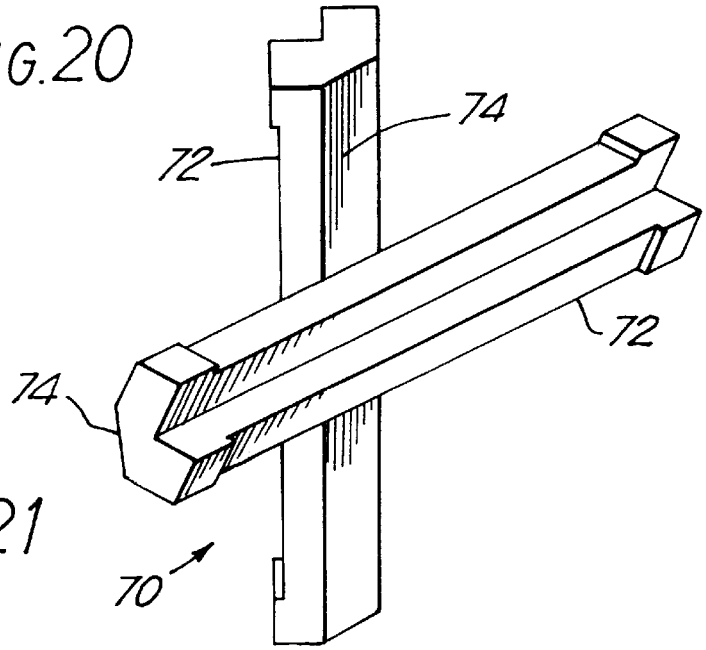

FIGS. 19–21—First Auxiliary Connecting Element—Midpoint Joinder

A first such auxiliary connecting element is indicated at 70 in FIGS. 19 to 21, and comprises two such half members, indicated at 72, integrally joined together at the midpoints of their flat sides 74 and extending at 90° to each other. A connecting element 70 can connect together two main elements 10 with their side surfaces 13 in contact with each other but with their respective grooves 20 extending perpendicularly to each other, thus further increasing the versatility of the toy.

Figure 22:
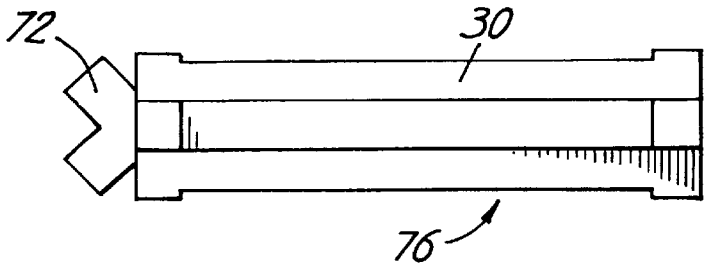
FIGS. 22 to 24 are plan, side and perspective views respectively of another form of auxiliary connecting element of the constructional toy of the present invention.
Figure 23:
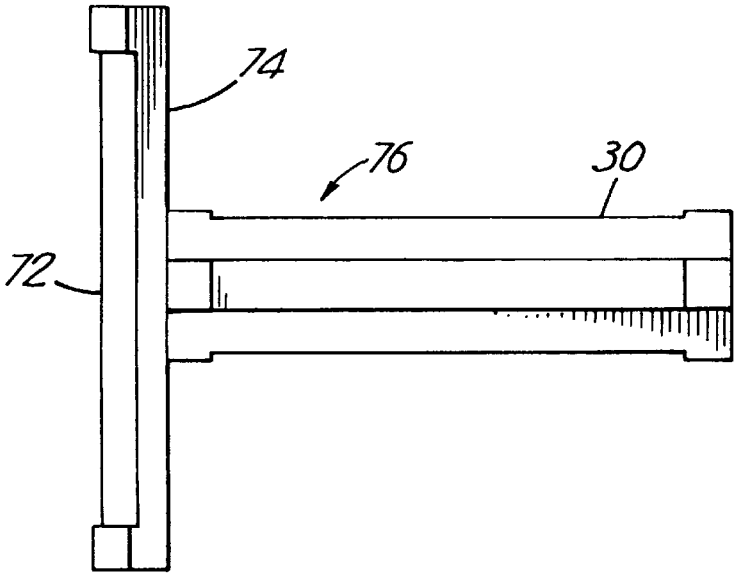
Figure 24:
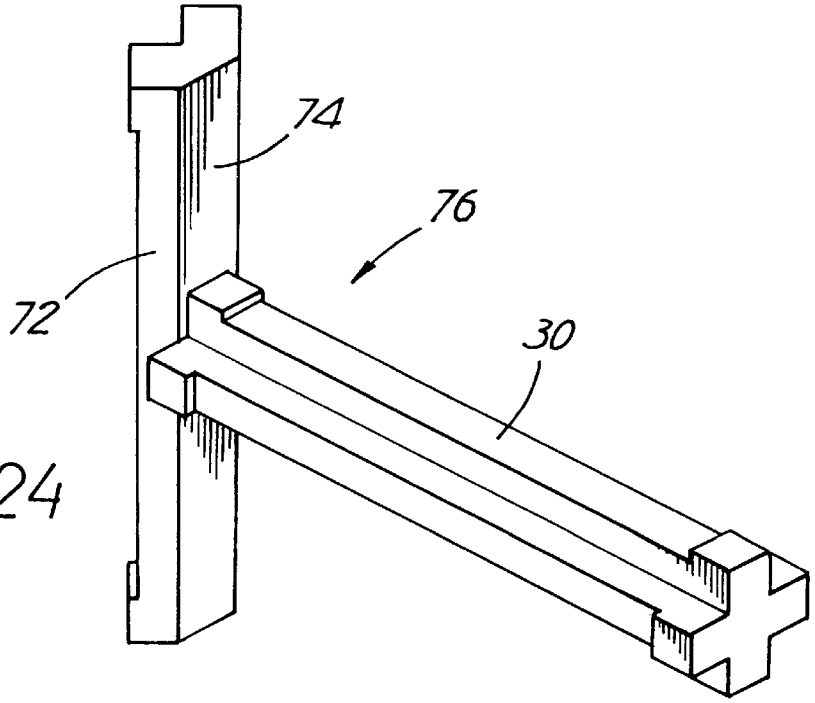

FIGS. 22–24—Second Auxiliary Connecting Element—End-To-Midpoint Joinder

A second form of auxiliary connecting element is indicated at 76 in FIGS. 22 to 24, and comprises one half element 72 having a connecting element 30 integrally joined to and projecting perpendicularly from the midpoint of its flat side 74, to form a T-shape. Again, main elements 10 can be connected together in additional relative orientations by means of the connecting elements 76.

FIGS. 22—24—Third Auxiliary Connecting Element—End-To-End Joinder

Figure 25:
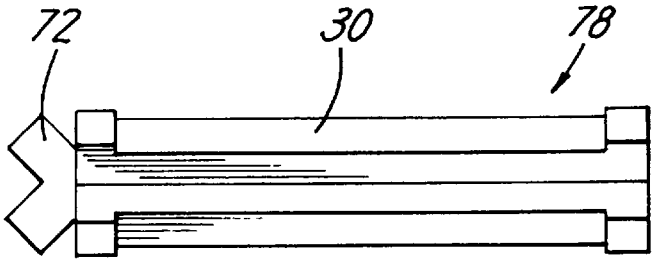
FIGS. 25 to 27 are plan, side and perspective views respectively of a still further form of auxiliary connecting element of the constructional toy of the present invention.
Figure 26:
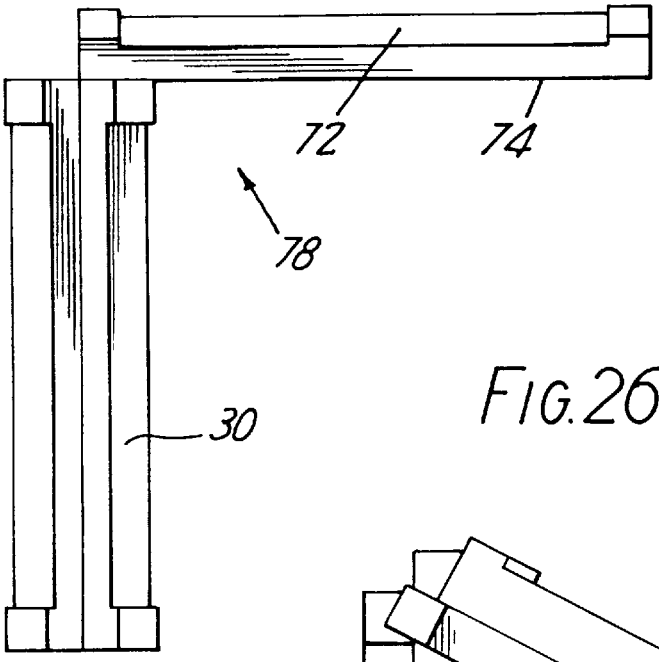
Figure 27:
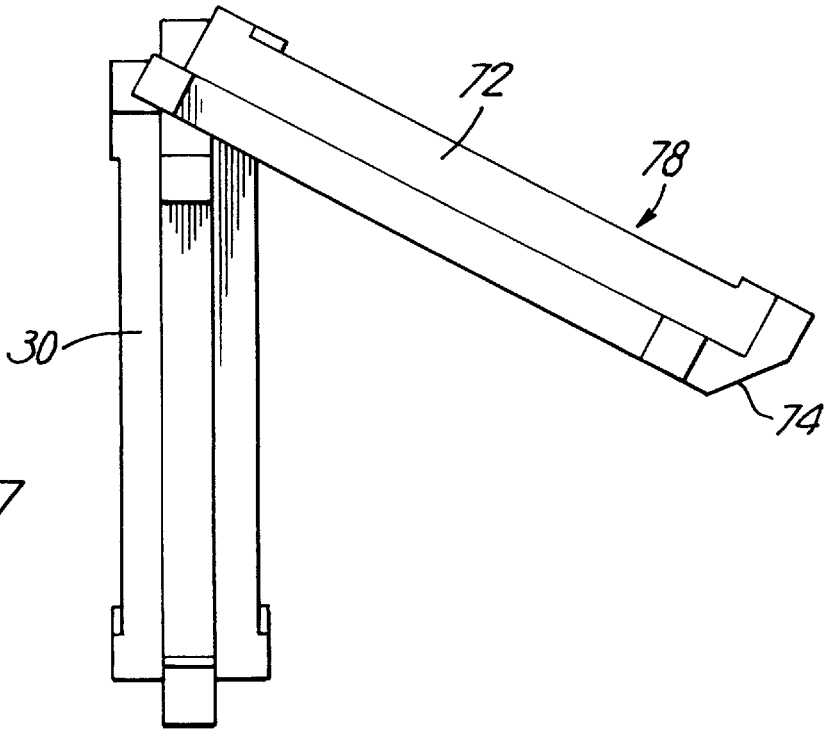

A third form of auxiliary connecting element is indicated 78 in FIGS. 25 to 27, and comprises a half element 72 having one end of its flat side 74 integrally joined to and projecting perpendicularly from one end of a connecting element 30, forming an L-shape (or an inverted L-shape, as viewed in FIGS. 26 and 27).

Figure 28:
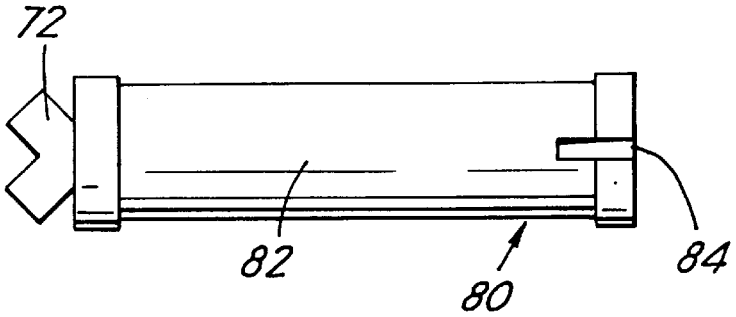
FIGS. 28 to 30 are plan, side and perspective views respectively of yet another form of auxiliary connecting element of the constructional toy of the present invention.
Figure 29:
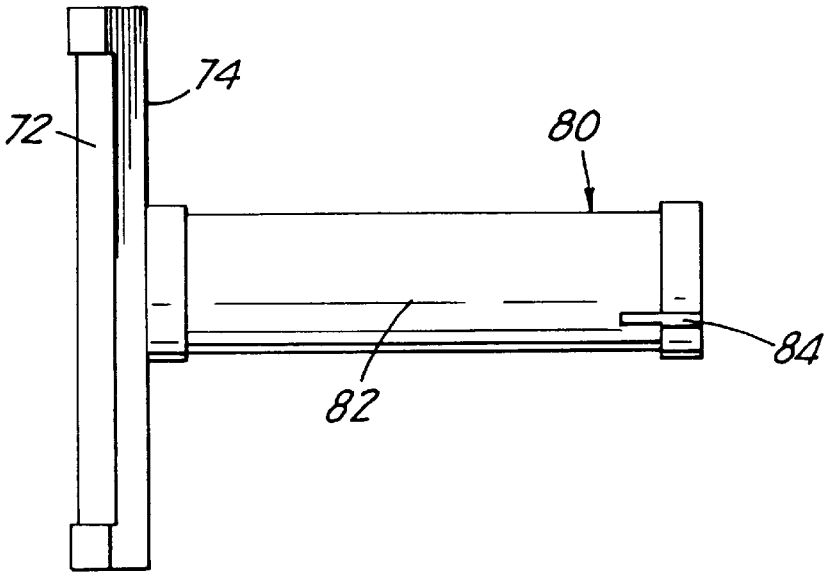
Figure 30:
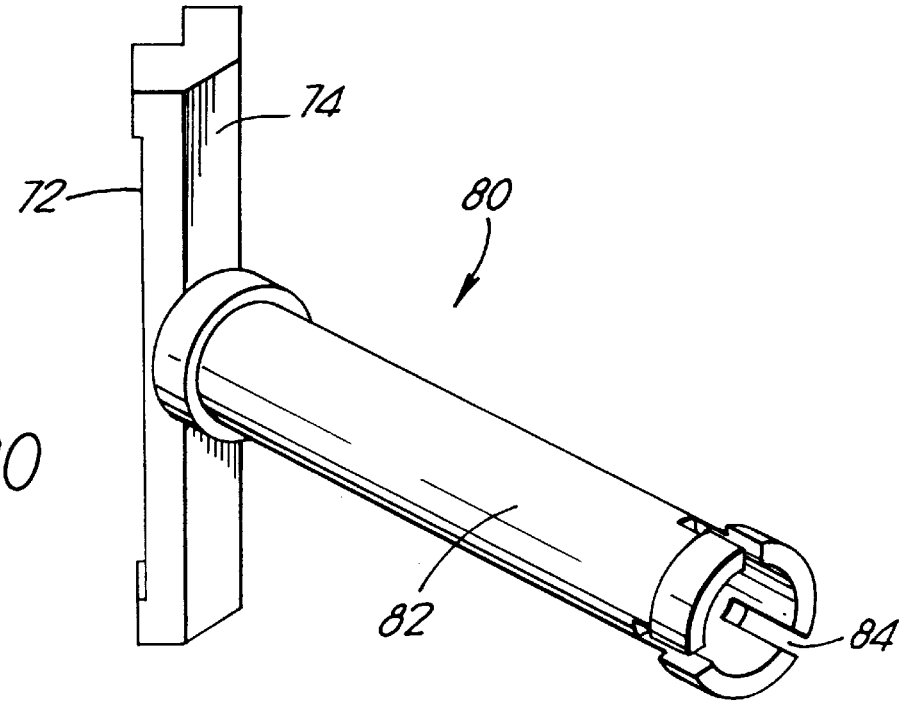

FIGS. 28–30—Fourth Auxiliary Connecting Element—Tubular Half

FIGS. 28 to 30 show a fourth auxiliary connecting element 80, which is basically similar in concept to the T-shaped element 76 but has the element 30 replaced by a tubular element 82 dimensioned to be a tight sliding fit in the apertures 24, 52, 66 of the various main building elements. The free end of the element 82 is slotted at 84 to give it some resilience, and can be arranged to be rotatable in its aperture if desired, thus further increasing the possible relative orientations of the main building elements and the versatility of the toy.

While the above description contains many specificities, these should not be construed as limitations on the scope of the invention, but as exemplifications of the presently preferred embodiments thereof. Many other ramifications and variations are possible within the teachings of the invention, as described above. Thus the scope of the invention should be determined by the appended claims and their legal equivalents, and not by the examples given.

We claim:

1. A construction toy, comprising:

a plurality of building blocks of at least two different types which can be assembled together to form a variety of three-dimensional structures, each of said blocks having a plurality of flat side surfaces with respective grooves therein, each groove having a mouth narrower than at least a part of the remainder of such groove, and an elongated connecting element having a cross-section in the shape of a symmetrical, multi-pointed star such that said connecting element has a plurality of elongated arms, said connecting element being dimensioned and shaped to make a tight sliding fit in any of said grooves of said blocks, with some of said arms trapped in said groove and the rest of said arms disposed outside said groove, such that said connecting element can be used to secure two of said blocks together, in a plurality of relative orientations, by engaging said connecting element in the respective grooves of two adjacent blocks, an auxiliary connecting element comprising first and second portions, said first portion being elongated, having an axis, and lying on one side of a plane which longitudinally bisects said connecting element, said first portion having a generally V-shaped cross-section with two arms defining an angle between said arms, said V-shaped cross section having a base that is flat and lying in said plane, such that said arms extend out in two different directions from said plane, said first portion being dimensioned and shaped to make a tight sliding fit in any of said grooves of said block, with said two arms of said V-shaped cross-section trapped in said groove, said second portion being elongated, having an axis, and lying on the other side of said plane which longitudinally bisects said connecting element, said second portion being attached to said base of said first portion, the axes of said first and second portions extending at an angle to each other, said second portion being dimensioned to make a tight sliding fit with a part of said block, whereby said auxiliary connecting element may be used to connect a plurality of said blocks in a variety of orientations.

2. The construction toy of claim 1 wherein said second portion of said auxiliary connecting element has a flat side and a midpoint of said first portion is joined to the midpoint of said flat side of said second portion of said auxiliary connecting element so that said axes of first and second portions extend at and angle of 90° to each other.

3. The construction toy of claim 1 wherein said first and second portions of said auxiliary connecting element are integrally joined and a intermediate point on said second portion is joined to said base of said first portion and said axis of second portion extends perpendicularly said axis of said first portion.

4. The construction toy of claim 1 wherein said first and second portions of said auxiliary connecting element are integrally joined and an end of second portion is joined to a midpoint of said base of said first portion, so that said axes of said first and second portions are oriented at 90° to each other.

5. The construction toy of claim 1 wherein:

each of said blocks has at least one cylindrical aperture extending thereinto and being parallel to said grooves of said block, the diameter of said aperture being such that said connecting element makes a tight sliding fit therein, and said second portion of said auxiliary connecting element comprises a tubular connecting element having one end integrally joined to and extending perpendicularly from a midpoint of said flat side of said first portion, said tubular connecting element being dimensioned to make a tight sliding fit in said cylindrical apertures of said blocks.

6. The construction toy of claim 1 wherein said elongated connecting element has four elongated arms and said grooves each have a mouth narrower than the remainder of such groove.

7. A construction toy, comprising:

a plurality of building blocks of at least two different types which can be assembled together to form a variety of three-dimensional structures, each of said blocks having a plurality of flat side surfaces with respective grooves therein, each groove having a mouth narrower than at least a part of the remainder of such groove, and an elongated connecting element having a cross-section in the shape of a symmetrical, multi-pointed star such that said connecting element has a plurality of elongated arms, said connecting element being dimensioned and shaped to make a tight sliding fit in any of said grooves of said blocks, with some of said arms trapped in said groove and the rest of said arms disposed outside said groove, such that said connecting element can be used to secure two of said blocks together in a plurality of relative orientations, by engaging said connecting element in the respective grooves of two adjacent blocks, each groove of each of said blocks having a slight indentation at each end thereof, said arms of said connecting elements each having a slight projection at each end of each arm, such that said slight projections on said connecting elements mate with said slight indentations of said grooves of said blocks to provide a detent to lock said any connecting elements more securely to any blocks when a connecting element is slid into a groove of a block.

8. The construction toy of claim 7 wherein said connecting elements have further slight projections at the midpoints of each arm, said further slight projections being similar to, but of about twice the length of, said first-mentioned projections, for cooperating with said slight indentations of said block when a connecting element is partially mated with a block.

9. The construction toy of claim 7 wherein each block has at least one cylindrical aperture extending thereinto, the axis of said aperture extending parallel to said grooves, the diameter of said aperture being such that said connecting element makes a tight sliding fit in said aperture, said apertures each having a slightly increased diameter portion, analogous to said slight indentations, on at least one end thereof, for cooperating with said projections on said connecting elements.

10. The construction toy of claim 7 wherein said elongated connecting element has four elongated arms and said grooves each have a mouth narrower than the remainder of such groove.

11. A construction toy, comprising:

a plurality of building blocks of at least two different types which can be assembled together to form a variety of three-dimensional structures, each of said blocks having a plurality of flat side surfaces with respective grooves therein, each groove having a mouth narrower than at least a part of the remainder of such groove, and an elongated connecting element having an axis and a cross-section in the shape of a symmetrical, multi-pointed star a plurality of elongated radial vanes which are parallel to said axis and which form arms of said star, said connecting element being dimensioned and shaped so that at least a pair of said radial vanes can make a tight sliding fit so as to be enraged in any one of said grooves of an one of said blocks with said radial vanes parallel said grooves, and so that the rest of said vanes will be disposed outside said one groove free of said one groove and said one block such that said rest of said radial vanes are free to mate in a similar manner in a groove of another adjacent block, with side surfaces of said one block and said adjacent block abutting each other, and with said pair of said radial vanes of said connecting element engaged in said one block and said rest of said vanes of said connecting element engaged in said adjacent block, each of said blocks having at least one cylindrical aperture having an internal side wall extending thereinto, the axis of said aperture extending parallel to the grooves on said side surfaces of said block, the diameter of said aperture being such that said connecting element also makes a tight sliding fit in said aperture, with outermost ends of said radial vanes engaging said internal side wall of said aperture, such that said connecting element can be used to secure two of said blocks together in a fist of a plurality of relative orientations where said cylindrical apertures of adjacent blocks are not coaxial, by engaging respectively separate sets of vanes of said connecting element in the respective grooves of two adjacent blocks, and such that said connecting element can be used to secure two of said blocks together in a second of said plurality of relative orientations where said cylindrical apertures of adjacent blocks are coaxial, by inserting said connecting element in the cylindrical apertures of two adjacent blocks.

12. The construction toy of claim 11 wherein said cylindrical aperture extends completely through said block.

13. The construction toy of claim 11 wherein said cylindrical aperture extends only partly through said block.

14. The construction toy of claim 11 wherein each of said blocks has a central axis and the axis of said cylindrical aperture coincides with the central axis of said block.

15. The construction toy of claim 11 wherein said elongated connecting element has four elongated vanes.

16. A construction toy, comprising:

a plurality of building blocks of at least two different types which can be assembled together to form a variety of three-dimensional structures, each of said blocks having a plurality of flat side surfaces with respective grooves therein, and an end surface which is perpendicular to said side surfaces, each groove of each block having a mouth narrower than at least a part of the remainder of such groove, and an elongated connecting element having a cross-section in the shape of a symmetrical, multi-pointed star with a plurality of elongated vanes parallel to said axis and elongated radial vanes parallel to said axis and forming arms of said star, said connecting element being dimensioned and shaped so that at least a pair of said radial vanes can make a tight sliding fit so as to be engaged in any one of said grooves of and one of said blocks with said radial vanes parallel to said grooves, and so that the rest of said vanes will be disposed outside said one groove and extend free of said one groove and said one block so that said rest of said radial vanes are free to mate in similar manner in a groove of another adjacent block, such that said connecting element can be used to secure two of said blocks together in a first of a plurality of relative orientations, by engaging respectively separate sets of vanes of said connecting element in the respective grooves of two adjacent blocks, with said pair of said radial vanes of said connecting element engaged in said one block and said rest of said vanes of said connecting element engaged in said adjacent block, and with side surfaces of said one block and said adjacent block abutting, each of said blocks having at least one cylindrical aperture having an internal side wall extending thereinto from said end surface of said block, the axis of said aperture extending parallel to the grooves on said side surfaces of said block, the diameter of said aperture being such that said connecting element also makes a tight sliding fit in said aperture with the outer ends of said radial vanes engaging said internal side wall of said aperture, said end surface of said block being flat and substantially closed, except for said aperture, the side of said block opposite to said end surface being substantially open and including an end of a cylindrical wall that surrounds and defines said aperture, at least one of said blocks being triangular in cross-section and at least another one of said blocks being square in cross section, such that said connecting element can be used to secure two of said blocks together in a second of said plurality of relative orientations where said cylindrical apertures of adjacent blocks are coaxial, by inserting said connecting element in the cylindrical apertures of two adjacent blocks.

17. The construction toy of claim 16 wherein said side surfaces of said square and triangular blocks all have the same width.

18. The construction toy of claim 16 wherein said blocks and said connecting elements have a plurality of different heights, in which the greater heights are integral multiples of the smaller heights.

19. The construction toy of claim 16 wherein each groove of said blocks is shaped to be substantially complimentary in cross-section to the cross-sectional shape of any two adjacent points of said star shaped cross-section of said connecting element.

20. The construction toy of claim 16 wherein said elongated connecting element has four elongated vanes.

* * * * *

UNITED STATES PATENT AND TRADEMARK OFFICE

CERTIFICATE OF CORRECTION

PATENT NO.: 5,957,744

DATED: Sept. 28, 1999

PATENTEES: J. C. Mott et al.

I t is certified that error appears in the above-identified patent and that said Letters Patent is hereby corrected as shown below:

Col. 10, line 23, change "fist" to —first—.

Signed and Sealed this

Eleventh Day of April, 2000

*Attest:*

*Attesting Officer*

Q. TODD DICKINSON

*Director of Patents and Trademarks*